US006960004B1

(12) United States Patent
Hsieh

(10) Patent No.: US 6,960,004 B1
(45) Date of Patent: Nov. 1, 2005

(54) COLLAPSIBLE LAMPSHADE

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 0 days.

(21) Appl. No.: 10/958,309

(22) Filed: Oct. 5, 2004

(51) Int. Cl.[7] ..... F21V 17/00
(52) U.S. Cl. ..... 362/450; 362/352; 362/434
(58) Field of Search ..... 362/351, 352, 362/355, 356, 357, 358, 360, 361, 433, 434, 362/449, 450

(56) References Cited

U.S. PATENT DOCUMENTS 566,255 A * 8/1896 Wagor ..... 362/449
3,162,377 A * 12/1964 Ozeki ..... 362/450
3,180,982 A * 4/1965 Derman et al. ..... 362/450
3,194,959 A * 7/1965 Bashaw et al. ..... 362/356
6,439,746 B2 * 8/2002 Huang ..... 362/352
6,808,294 B2 * 10/2004 Pazula et al. ..... 362/352
2004/0080950 A1 * 4/2004 Lin ..... 362/352

* cited by examiner

*Primary Examiner*—Y. My Quach-Lee
(74) *Attorney, Agent, or Firm*—Abelman, Frayne & Schwab

(57) ABSTRACT

A lampshade includes first and second annular members, a plurality of spaced-apart flexible supporting rods disposed between the first and second annular members, and a flexible cover sheet body covering the supporting rods. Each supporting rod has first and second ends connected respectively to the first and second annular members. The supporting rods are curved to bulge outwardly to a first position. The first and second annular members are rotatable in opposite directions so as to twist simultaneously the supporting rods to a second position, and are compressible to move toward each other to fold the supporting rods from the second to a third position. The supporting rods are resilient to restore from the third to the first position when the first and second annular members are pulled apart from each other.

3 Claims, 5 Drawing Sheets

COLLAPSIBLE LAMPSHADE

BACKGROUND OF THE INVENTION

1. Field of the Invention

The invention relates to a lampshade, more particularly to a lampshade that is collapsible so as to be easily stored, transported, and used.

2. Description of the Related Art

A conventional lampshade generally includes a frame made of a hard material, and a cover body covering the frame. Since the frame is made of a hard material, the conventional lampshade cannot be collapsed such that it occupies a substantial space during storage and transport.

SUMMARY OF THE INVENTION

Therefore, the object of the present invention is to provide a lampshade that is collapsible so as to facilitate its storage, transport and use.

According to this invention, a lampshade comprises first and second annular members, a plurality of spaced-apart flexible supporting rods disposed between the first and second annular members, and a flexible cover sheet body covering the supporting rods. Each of the supporting rods has a first end connected to the first annular member, and a second end connected to the second annular member. The supporting rods are curved to bulge outwardly to a first position. The first and second annular members are rotatable in opposite directions so as to twist simultaneously the supporting rods to a second position, and are compressible to move toward each other to fold the supporting rods from the second position to a third position. The supporting rods are resilient to restore from the third position to the first position when the first and second annular members are pulled apart from each other.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
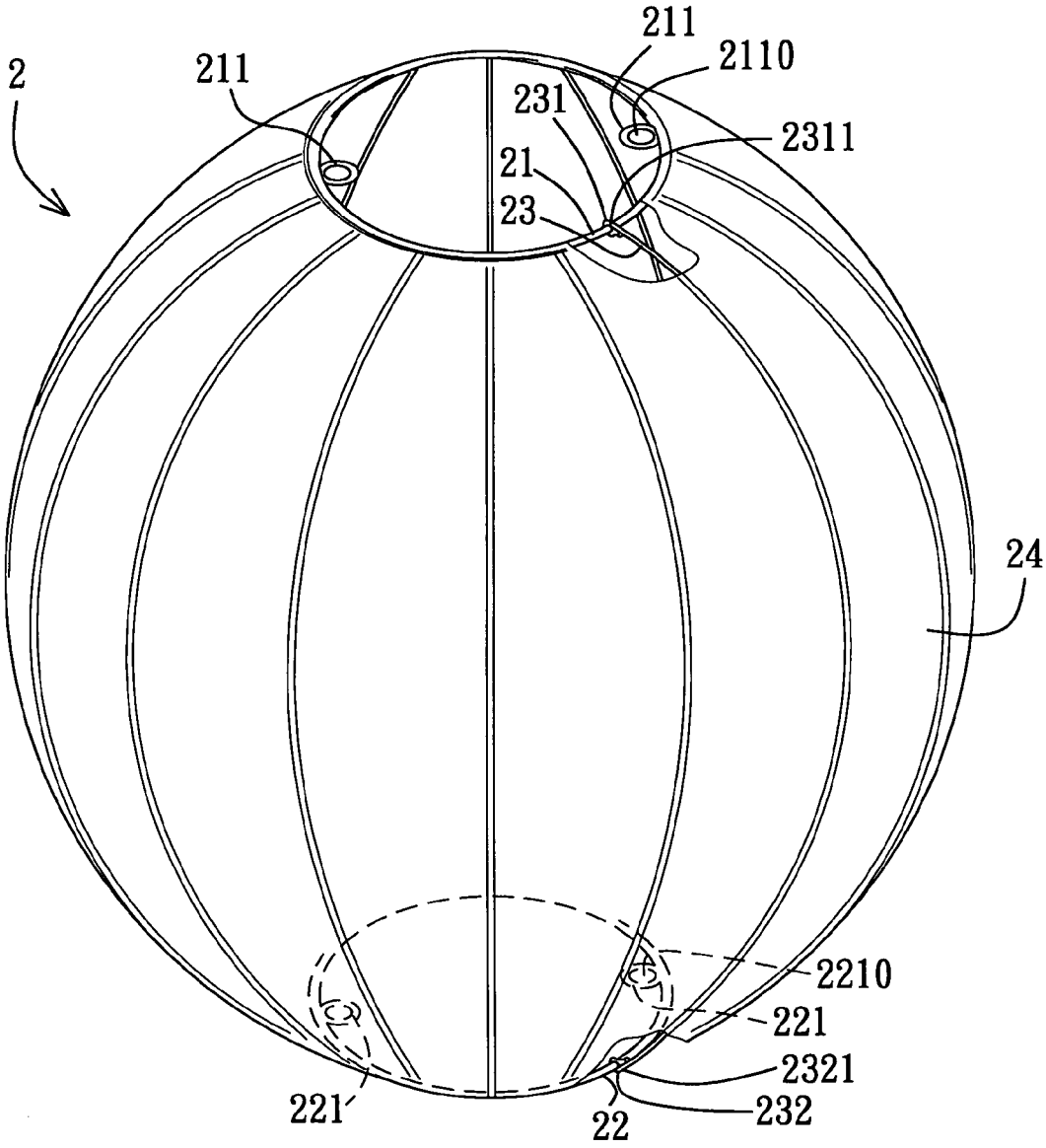
FIG. 1 is a perspective view of the preferred embodiment of a lampshade according to the present invention.

Referring to FIG. 1, the preferred embodiment of a lampshade 2 according to the present invention is shown to comprise a first annular member 21, a second annular member 22, a plurality of spaced-apart supporting rods 23, and a flexible cover sheet body 24. The first and second annular members 21, 22 and the supporting rods 23 are made of flexible materials, such as iron strips or plastic.

Each of the first and second annular members 21, 22 is formed with two lugs 211, 221 that project inwardly and radially from a respective one of the first and second annular members 21, 22. Each of the lugs 211, 221 has a hole 2110, 2210.

Each of the supporting rods 23 is elongated, and has a first end 231 formed with a hook element 2311 to engage the first annular member 21, and a second end 232 formed with a hook element 2321 to engage the second annular member 22.

The cover sheet body 24 is adhered to outer surfaces of the supporting rods 23 and around the first and second annular members 21, 22 so as to cover the same. The cover sheet body 24 may include a single flexible sheet or a plurality of sheet segments.

Figure 2:
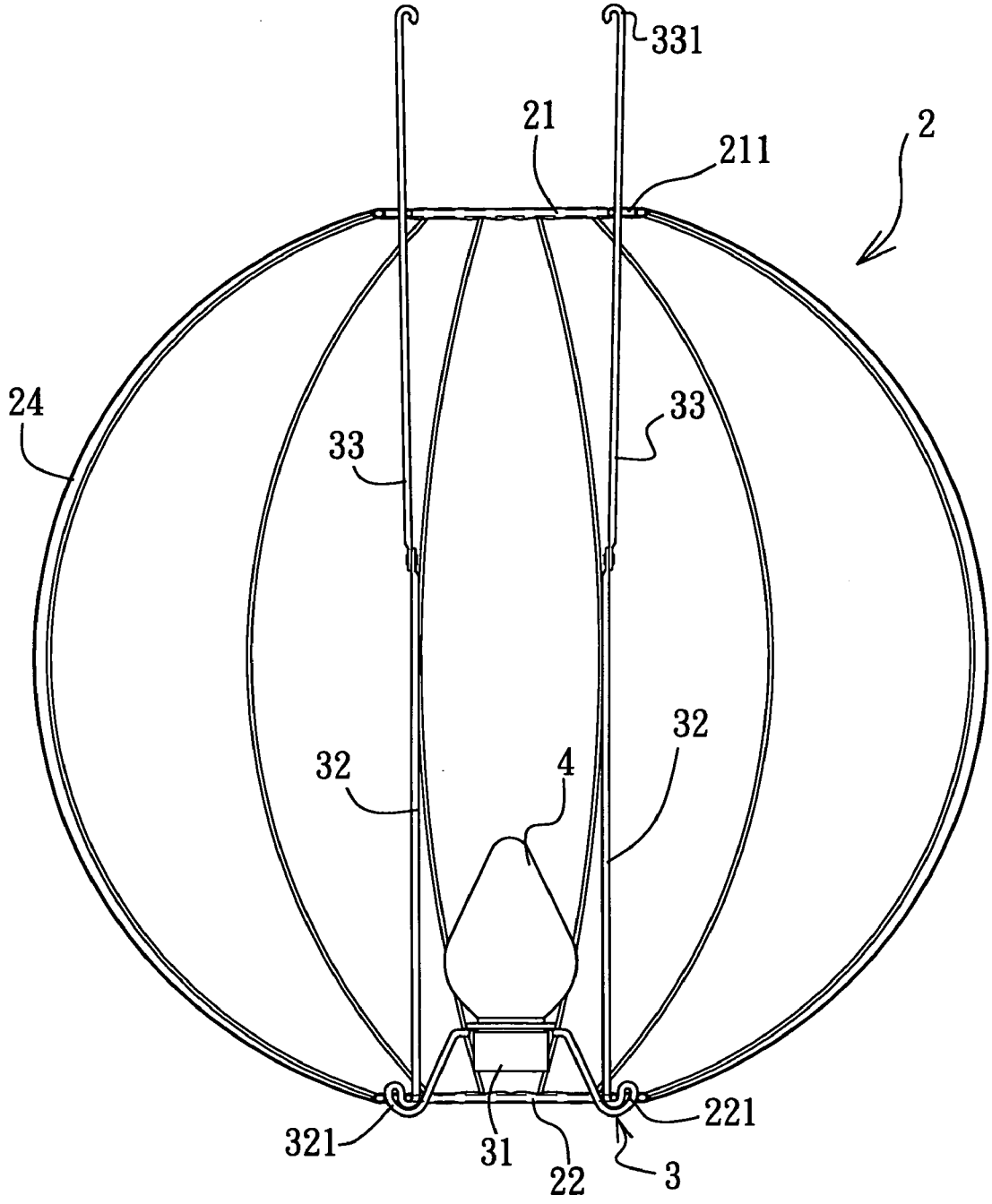
FIG. 2 is a schematic view of the preferred embodiment in a state of use.

Normally, the lampshade 2 is formed as shown in FIG. 1, wherein the supporting rods 23 are curved so as to bulge outwardly to a first position. During use, the lampshade 2 may be provided with a lamp seat 3, as shown in FIG. 2. In this embodiment, the lamp seat 3 includes a positioning disc 31 for positioning a bulb 4, two upright legs 32, and two extension legs 33. One end of each upright leg 32 is curved so as to form a first hook section 321 to engage a respective lug 221 of the second annular member 22, and then extends upwardly and is fixed to the positioning disc 31. Each of the extension legs 33 has one end connected pivotally to a respective upright leg 32, and another end that is passed through a respective lug 211 of the first annular member 21 and that is curved to form a second hook section 331. Since the lamp seat 3 is not pertinent to the present invention, its structure does not form any limitation to the present invention. During use of the lampshade 2, the lamp seat 3 is disposed within the lampshade 2, and the first hook sections 321 of the upright legs 32 are hooked to the respective lugs 221 of the second annular member 22. Furthermore, through the extension legs 33 that extend through the respective lugs 211 of the first annular member 21, the lampshade 2 and the lamp seat 3 are connected to form an integral body. Using the second hook sections 331 of the extension legs 33, the assembly of the lampshade 2 and the lamp seat 3 may be hung on any fixed object, such as a ceiling, a post, a table, etc.

Figure 3:
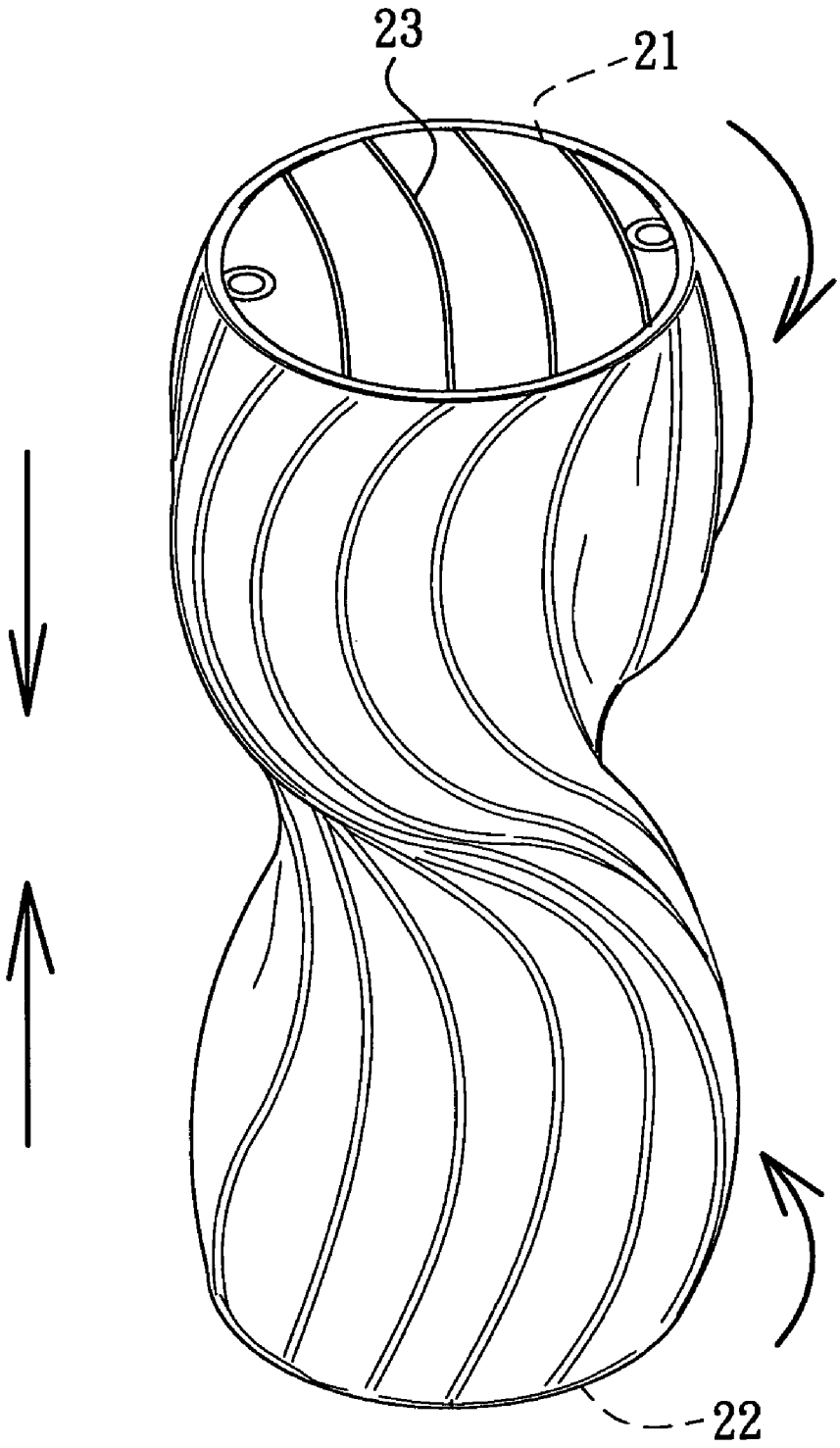
FIGS. 3 and 4 illustrate how the lampshade of the present invention may be collapsed.
Figure 4:
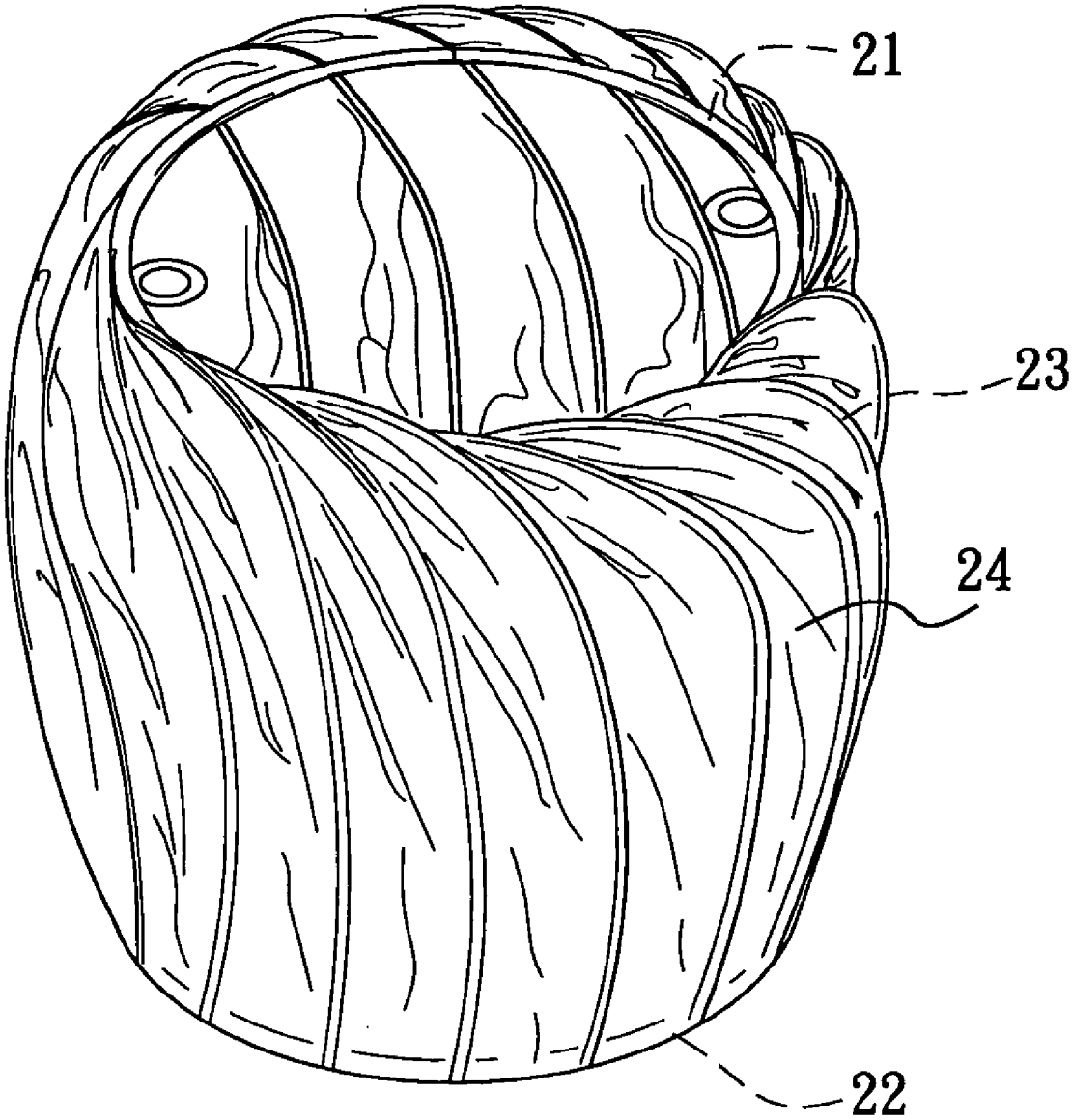
Figure 5:
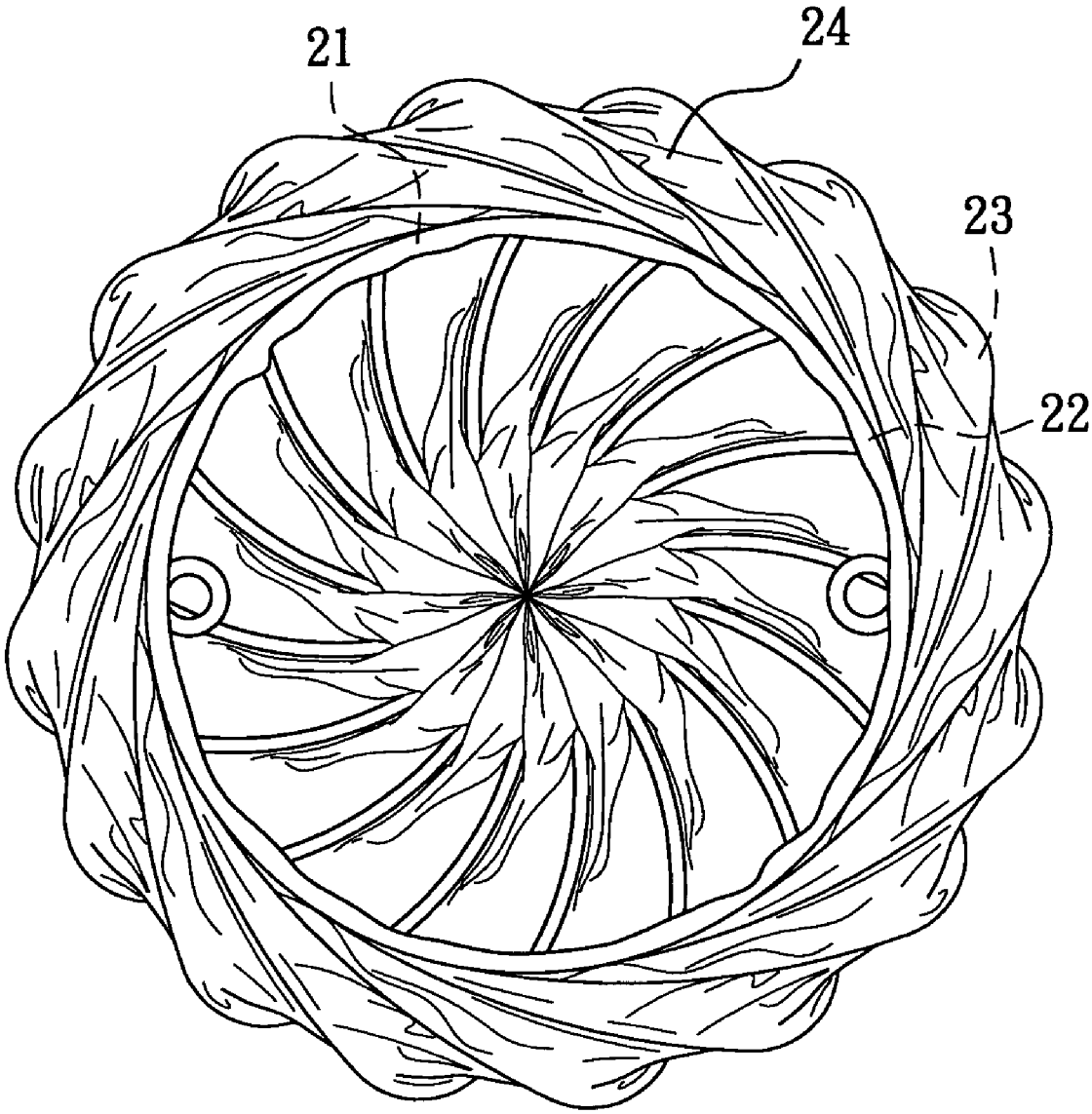
FIG. 5 is a schematic top view of FIG. 4.

Referring to FIG. 3, the lampshade 2 of the present invention may be collapsed by rotating the first and second annular members 21, 22 in opposite directions, as shown by the curved arrows in FIG. 3, so as to twist simultaneously the supporting rods 23 to a second position. Next, the first and second annular members 21, 22 are compressed to move toward each other, as shown by the upward and downward arrows in FIG. 3, to collapse the supporting rods 23 from the second position to a third position. The lampshade 2 is, at this time, collapsed to result in the formation shown in FIGS. 4 and 5. The volume of the lampshade 2 is noticeably reduced when collapsed. Hence, a plurality of lampshades 2 may be stacked so as to save storage space, and the transport of the lampshades 2 is made more convenient.

When the first and second annular members 21, 22 are pulled apart from each other to unfold the collapsed lampshade 2 for use, the supporting rods 23, which are resilient, are restored to the first position from the third position.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A lampshade comprising:

a first annular member;

a second annular member;

a plurality of spaced-apart flexible supporting rods disposed between said first and second annular members, each of said supporting rods having a first end connected to said first annular member, and a second end connected to said second annular member, said supporting rods being curved to bulge outwardly to a first position; and a flexible cover sheet body covering said supporting rods;

wherein said first and second annular members are rotatable in opposite directions so as to twist simultaneously said supporting rods to a second position, and are compressible to move toward each other to fold said supporting rods from said second position to a third position;

wherein said supporting rods are resilient to restore from said third position to said first position when said first and second annular members are pulled apart from each other; and wherein each of said supporting rods is elongated, each of said first and second ends being formed with a hook element for engaging a respective one of said first and second annular members.

2. A lampshade comprising:

a first annular member;

a second annular member;

a plurality of spaced-apart flexible supporting rods disposed between said first and second annular members, each of said supporting rods having a first end connected to said first annular member, and a second end connected to said second annular member, said supporting rods being curved to bulge outwardly to a first position; and a flexible cover sheet body covering said supporting rods;

wherein said first and second annular members are rotatable in opposite directions so as to twist simultaneously said supporting rods to a second position, and are compressible to move toward each other to fold said supporting rods from said second position to a third position;

wherein said supporting rods are resilient to restore from said third position to said first position when said first and second annular members are pulled apart from each other; and wherein each of said first and second annular members is formed with two lugs that project inwardly and radially from a respective one of said first and second annular members.

3. The lampshade as claimed in claim 2, wherein each of said lugs has a hole.

* * * * *